US006558062B1

(12) United States Patent
Wyant et al.

(10) Patent No.: US 6,558,062 B1
(45) Date of Patent: May 6, 2003

(54) BINDER WITH EXPANDABLE OUTSIDE POCKET

(75) Inventors: Jon R. Wyant, Centerville, OH (US); Marc L. Moor, Pittsburgh, PA (US)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/528,590

(22) Filed: Mar. 20, 2000

Related U.S. Application Data

(60) Provisional application No. 60/124,943, filed on Mar. 18, 1999.

(51) Int. Cl.[7] ..... B42F 13/00

(52) U.S. Cl. ..... 402/73; 402/70; 281/21.1; 281/29; 281/37; 206/425

(58) Field of Search ..... 281/29, 31, 36, 281/37, 45, 51, 21.1, 15.1; 402/70, 73, 4; 206/425; 150/112, 118, 131

(56) References Cited

U.S. PATENT DOCUMENTS

| | | | | |
|---|---|---|---|---|
| 138,217 | A | | 4/1873 | Wendt |
| 1,023,834 | A | | 4/1912 | Gareis |
| 1,359,320 | A | | 11/1920 | Brenan |
| 1,492,677 | A | | 5/1924 | Dunbar et al. |
| 2,173,120 | A | | 9/1939 | Lifton |
| 2,252,783 | A | | 8/1941 | Potts et al. |
| 2,318,192 | A | | 5/1943 | Boelema |
| 2,473,056 | A | | 6/1949 | Henderson |
| 2,475,067 | A | | 7/1949 | Wege |
| 2,737,220 | A | | 3/1956 | Hoff |
| 3,310,321 | A | | 3/1967 | Freund |
| 3,758,136 | A | | 9/1973 | Guyer |
| 4,782,874 | A | | 11/1988 | Chartier |
| 4,853,994 | A | | 8/1989 | Ekstein |
| 4,964,508 | A | | 10/1990 | Balsley |
| 5,370,419 | A | * | 12/1994 | Takayama ..... 281/31 |
| 5,378,022 | A | | 1/1995 | French et al. |
| 5,411,293 | A | | 5/1995 | Monzyk |
| 5,676,482 | A | * | 10/1997 | Hawkins ..... 402/79 |
| 5,720,564 | A | | 2/1998 | Winzen |
| 5,916,280 | A | * | 6/1999 | Lantz ..... 281/29 X |

FOREIGN PATENT DOCUMENTS

| | | |
|---|---|---|
| DE | 1632529 | 10/1969 |
| FR | 1033510 | 7/1953 |
| WO | 9424900 | 11/1994 |

OTHER PUBLICATIONS

PCT International Search Report; PCT Application No. PCT/US 00/07126; filed on Mar. 17, 2000.

* cited by examiner

*Primary Examiner*—Willmon Fridie, Jr.
(74) *Attorney, Agent, or Firm*—Thompson Hine LLP

(57) ABSTRACT

An expandable outside pocket is provided on one panel of a binder. This pocket includes a releasable closure to control expansion of the pocket. In one configuration, the outside pocket includes a zippered gusset, where the zipper can be closed to prevent expansion of the pocket capacity. The gusset and zipper configuration enables the pocket to be expanded when it is desired to increase the size of the pocket in order to accommodate larger items such as books, but also enables the gusset to be held in a non-extendable position when the pocket does not need to be expanded, such as when the pocket is only used to carry papers or slim folders. A second zipper is preferably also provided in order to control access to the pocket. In another configuration, the outside pocket includes gussets along its sides which facilitate expansion of the pocket, and a single zipper provides access to the pocket interior when unzipped and also enables the pocket to expand when unzipped. The pocket can be expanded to provide simple access to the pocket interior, permitting convenient perusal of papers within the pocket without removal of the papers.

12 Claims, 8 Drawing Sheets

BINDER WITH EXPANDABLE OUTSIDE POCKET

CROSS-REFERENCE TO RELATED APPLICATIONS

This application claims the benefit of U.S. Provisional Application No. 60/124,943 filed Mar. 18, 1999.

BACKGROUND OF THE INVENTION

The organization of school supplies for transportation, storage and use continues to be a problem for students. Folders, binders and notebooks routinely have pages and materials crammed into them in an unorganized manner. The corners of notebooks, papers and folders are frequently damaged and torn. Folders are often significantly larger than the associated notebooks and papers and they cannot be accommodated within the binder and they do not stack neatly. In the binder area in particular, there is a continuing need to provide suitable products capable of conveniently carrying the ever-increasing quantity of materials which students seem to accumulate. While one solution to this problem is to provide ever larger binders, such large binders can be cumbersome and difficult to carry and do not account for those situations where a student does not need such a large storage capacity.

Accordingly, it would be desirable and advantageous to provide a binder which can be configured for increased capacity when needed, but which does not take up excess space when the increased capacity is not needed or used, and it would also be desirable to provide a binder with extra storage space which is easily accessible.

SUMMARY OF THE INVENTION

Several different binder designs can be used in conjunction with the present invention, such as a conventional design with front and back panels, a multi-fold case with front and back panels and an enclosing panel which is connected to one panel and folds at least partially over the other panel when the binder is closed, or a zippered case design with front and back panels which can be zippered together in a binder interior enclosing configuration.

In accordance with the broadest aspect of the invention, an expandable outside pocket is provided on one panel of the binder. This pocket is typically located on the outside of the back panel and expands to accommodate different items according to their size, with a releasable closure provided to control expansion of the pocket.

In one embodiment, the outside pocket includes a zippered gusset, where the zipper can be closed to prevent expansion of the pocket capacity. The gusset and zipper configuration enables the pocket to be expanded when it is desired to increase the size of the pocket in order to accommodate larger items such as books, but also enables the gusset to be held in a non-extendable position when the pocket does not need to be expanded, such as when the pocket is only used to carry papers or slim folders. A second zipper is preferably also provided in order to control access to the pocket.

In another embodiment, the outside pocket includes gussets along its sides which facilitate expansion of the pocket, and a single zipper provides access to the pocket interior when unzipped and also enables the pocket to expand when unzipped. The pocket can be expanded to provide simple access to the pocket interior, permitting convenient perusal of papers within the pocket without removal of the papers.

DETAILED DESCRIPTION

Figure 1:
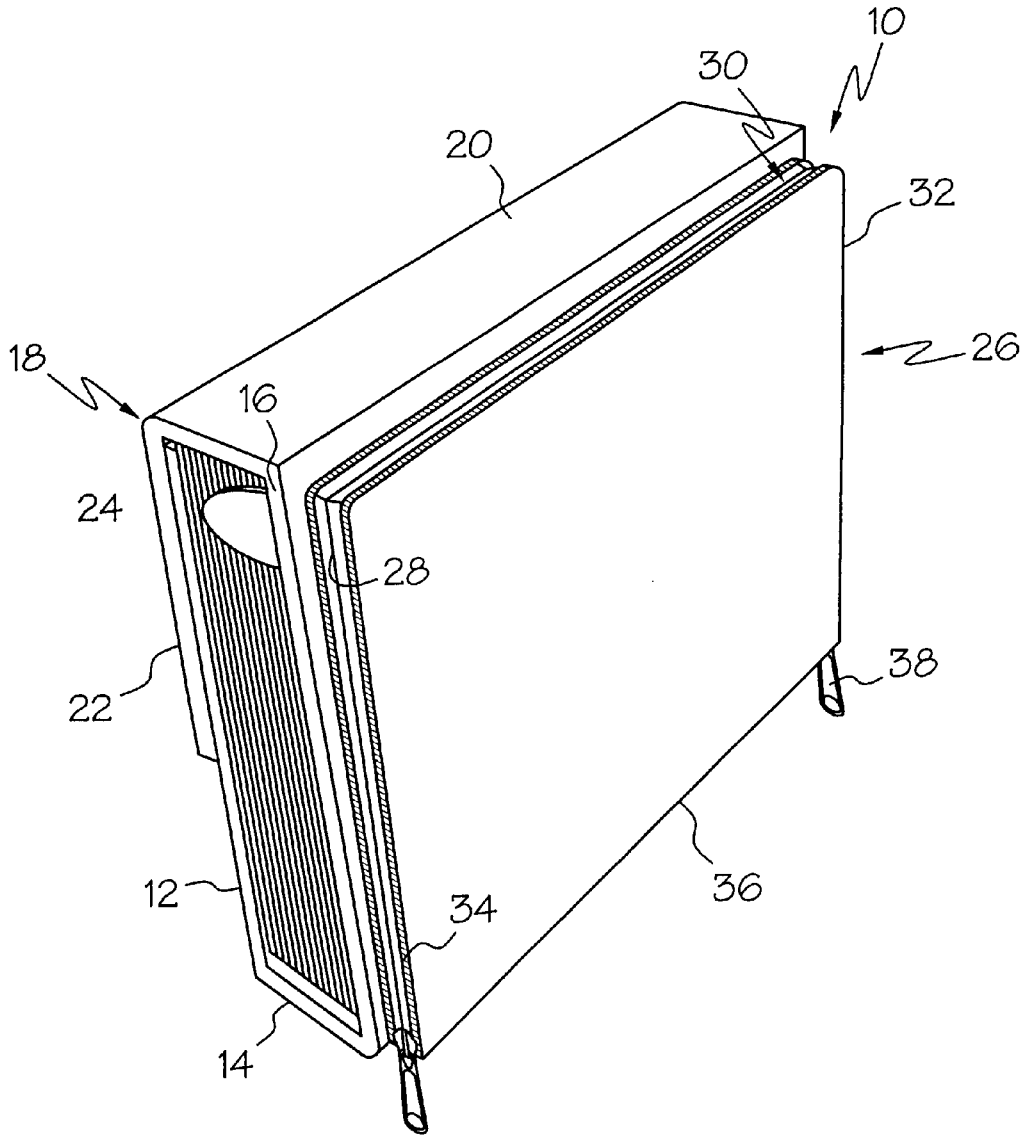
FIG. 1 is a perspective view of a binder with an outside pocket.
Figure 2:
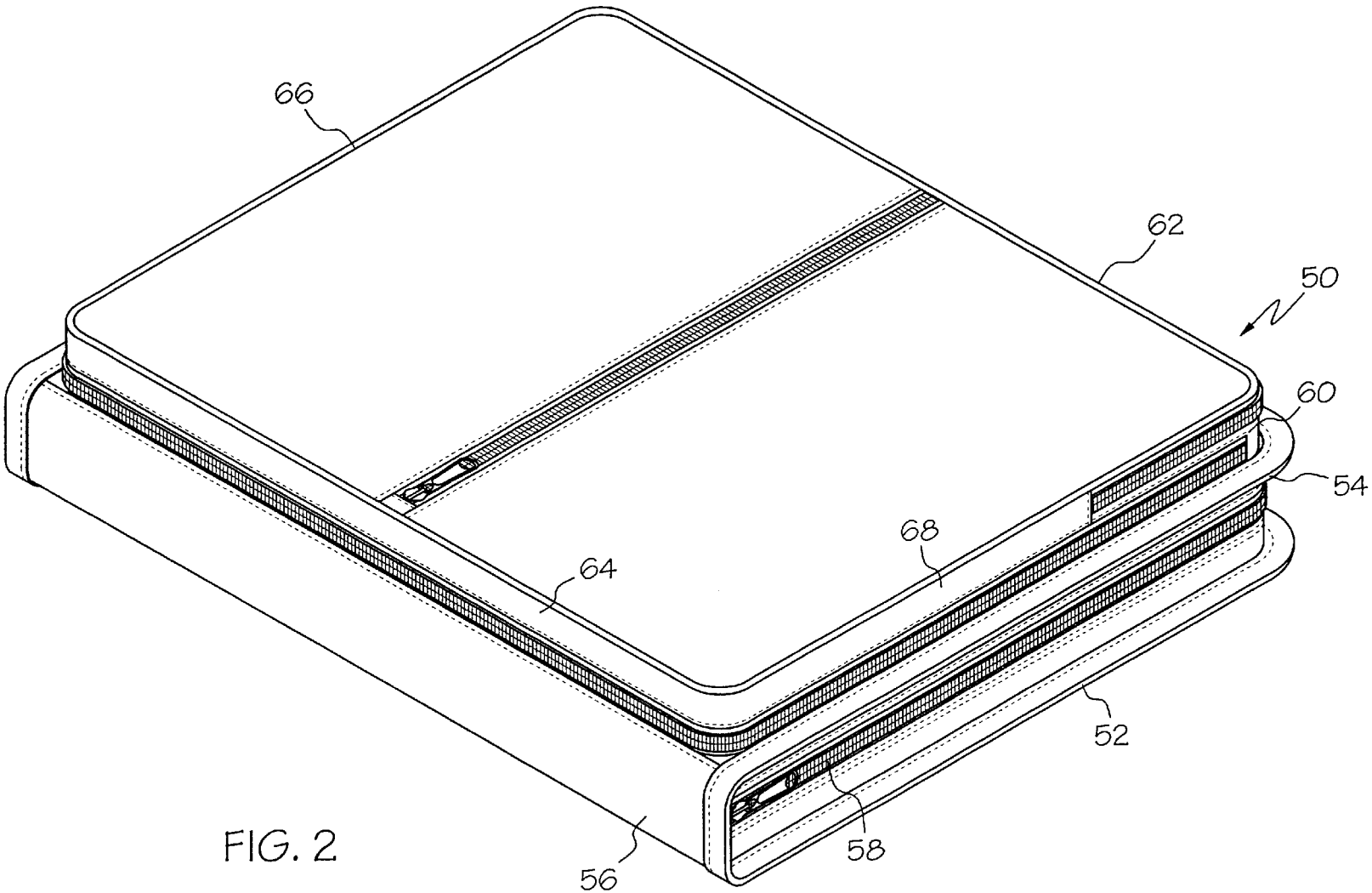
FIG. 2 is a perspective view of another binder with an outside pocket.

Referring to drawing FIG. 1, a perspective view of an exemplary binder 10 is shown. Th illustrated binder 10 is multi-fold case type binder including a front panel 12, spine 14, and back panel 16 movably connected to the front panel 12 via the spine 14. An enclosure panel 18 extends from the edge of back panel 16 and includes two segments 20 and 22, with segment 20 covering an end of the binder located near binder clip fixture 24 and segment 22 extending partially over front panel 12. Typically segment 22 is releasably attached to front panel 12 via known means such as corresponding hook and loop type fasteners for holding the binder in the illustrated closed configuration. By unfastening such means the binder 10 can be opened to provide access to its interior which may include various folders, notepads etc.

In accordance with the invention an expandable pocket 26 is provided. This pocket 26 is located on the outside of panel 16 and is preferably formed with gusseted sides 28, 30 and 32 which can be zippered shut by zipper 34 when the pocket 26 is not in use or when the larger capacity of the pocket 26 is not needed. The outside pocket 26 may be designed such that it expands equally at the bottom side and top side so that the pocket can accommodate an additional notebook or a text book, or may be designed to open a greater amount at the top side 30 or bottom side 36. A further zipper 38 may also be provided for controlling access to an interior of the pocket 26 through an opening defined by the unzipped zipper 38.

Figure 3:
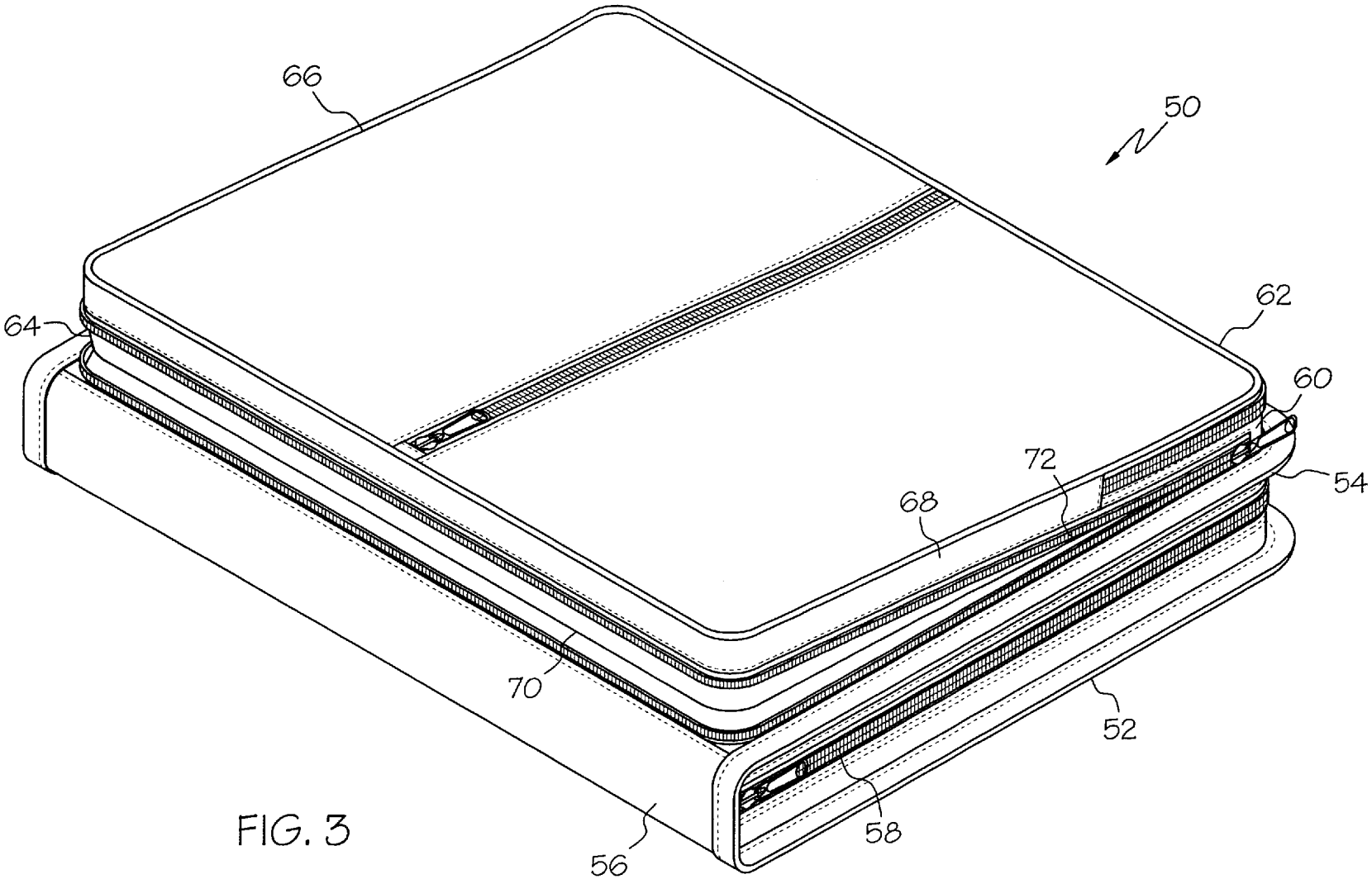
FIG. 3 is a perspective view of the binder of FIG. 2 with the pocket in an expanded state.
Figure 4:
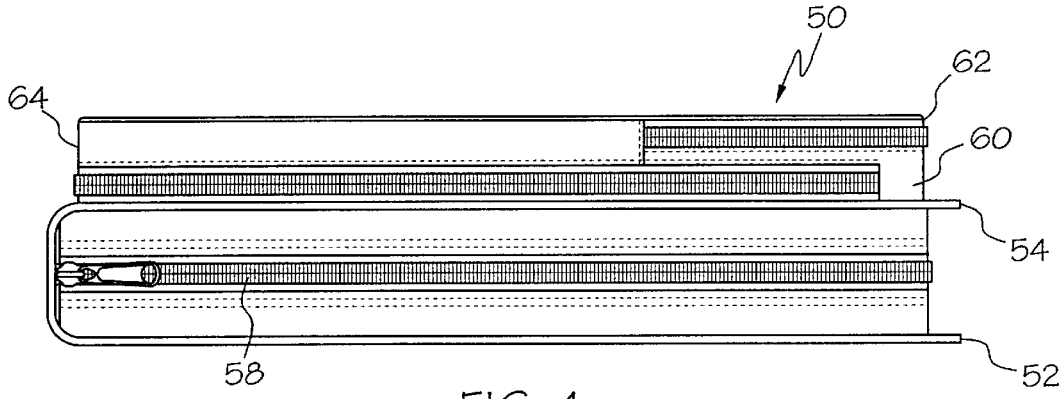
FIG. 4 is an end elevation of FIG. 2.

In one preferred embodiment illustrated in FIGS. 2–7, a zippered case type binder 50 is provided. The binder 50 includes a front panel 52 movably connected to a back panel 54 via a spine 56 of the binder 50. A releasable closure in the form of zipper 58 is provided for holding the panels adjacent each other when it is desired to keep the binder 50 in a closed configuration, typically used during transport of the binder to prevent contents within the binder interior from falling out. An outer pocket 60 is provided on the back panel 54 and is defined by sides opposed sides 62 and 64 and opposed sides 66 and 68 extending therebetween. A gusset 70 extends substantially along sides 68 and 66 and completely along side 64 to enable expansion of the pocket 60 as best seen in FIG. 3. The gusset 70 may be formed as a unitary piece as shown or may alternatively be formed by a number of different pieces of material. While a gusset 70 with fold creases is shown, it is recognized that the gusset could readily be formed without fold creases to achieve similar expansion of the pocket 60.

A releasable closure in the form of a zipper 72 extending substantially coincident with the gusset 70 is provided for controlling expansion of the pocket 60. In particular, when place in a closed or zipped condition the zipper 72 prevents expansion of the pocket (FIGS. 2 and 4) and when in an open or unzipped condition the zipper 72 permits expansion of the pocket 60 (FIGS. 3 and 5–7). In this manner, the total thickness of the binder can be kept to a minimum when the full capacity of the outer pocket 60 is not used or needed. When the extra capacity is in fact needed, the zipper 72 can be unzipped to allow for pocket expansion, increasing the volume of the pocket interior.

Figure 6:
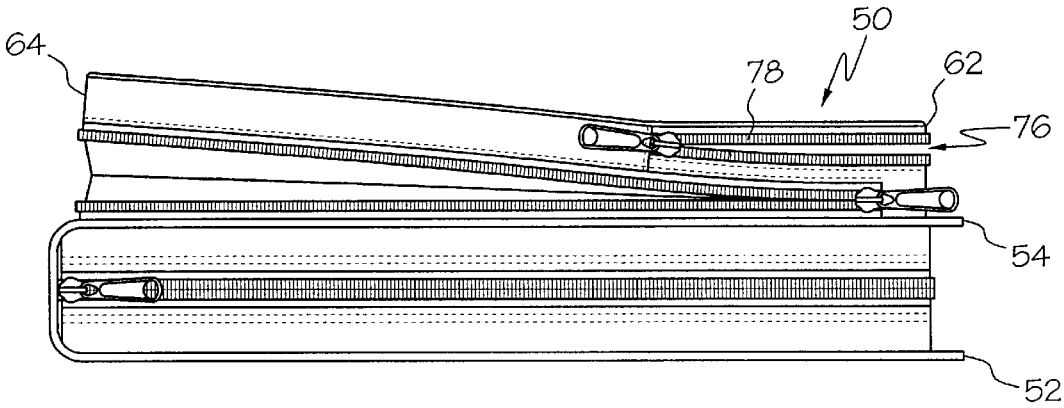
FIG. 6 is an end elevation of the binder of FIG. 2 showing an opening of the pocket unzipped.
Figure 7:
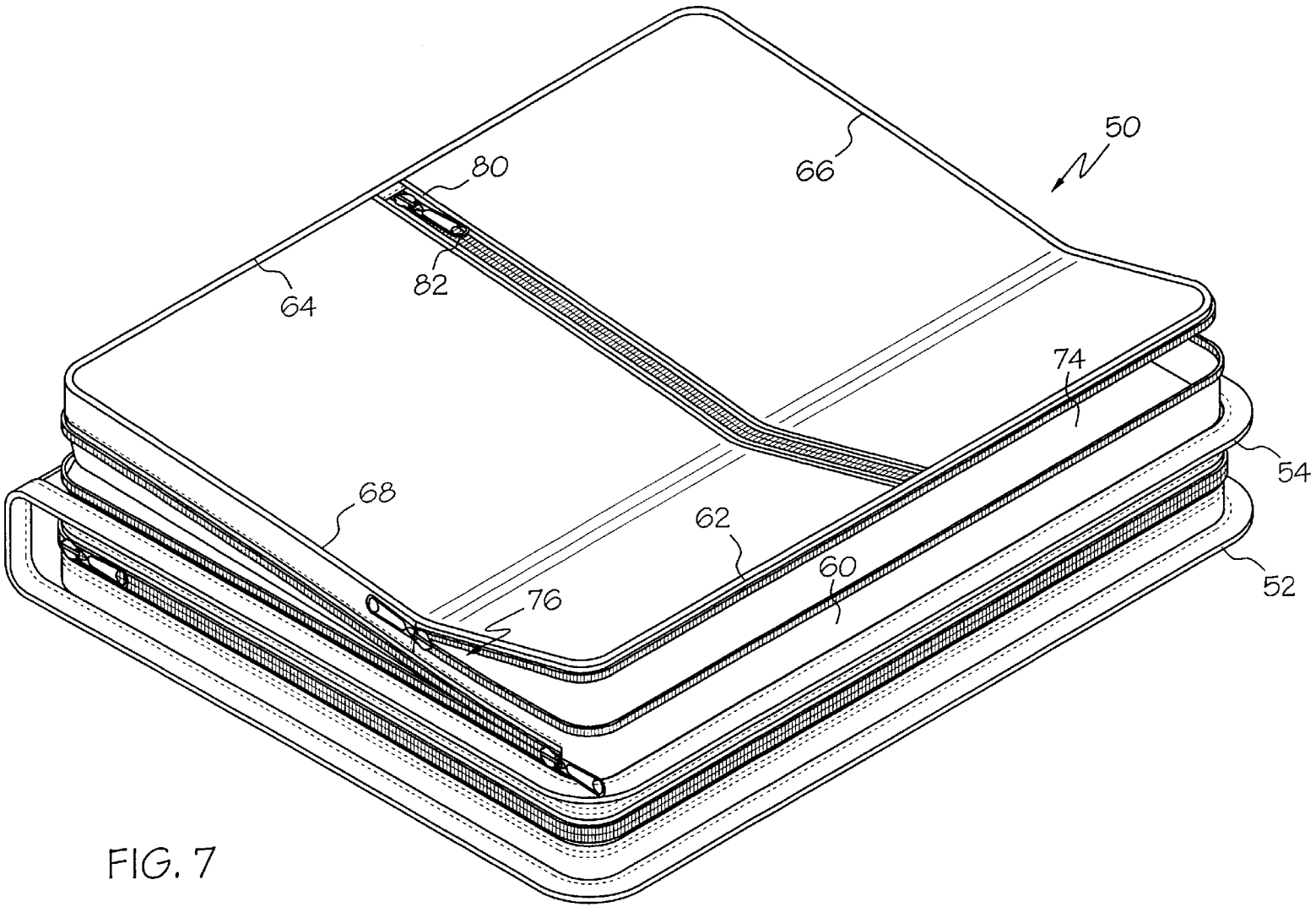
FIG. 7 is perspective view of the binder of FIG. 2 showing the pocket in an open state and an expanded state.
Figure 8:
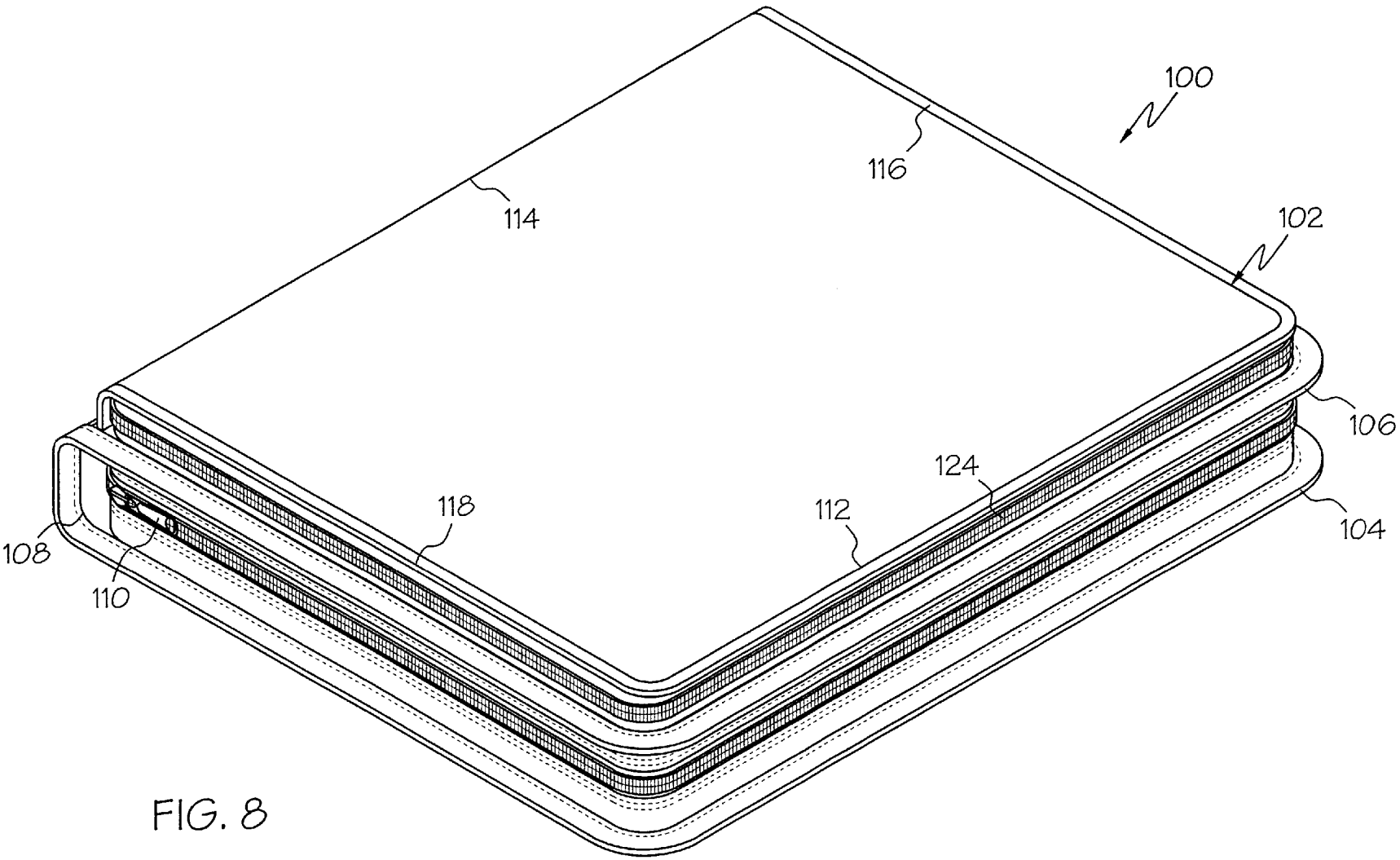
FIG. 8 is a perspective view of another binder with an outside pocket.

Access to the pocket interior 74 (FIG. 7) is provided from side 62 which includes an opening 76 which is defined by a releasable closure such as zipper 78 as best seen in FIGS. 6 and 7. The zipper 78 preferably extends completely along side 62 and partially along sides 66 and 68 as shown to provide for a larger opening, but could also be located only along side 62. Zipper 78 is positioned above zipper 72.

Figure 5:
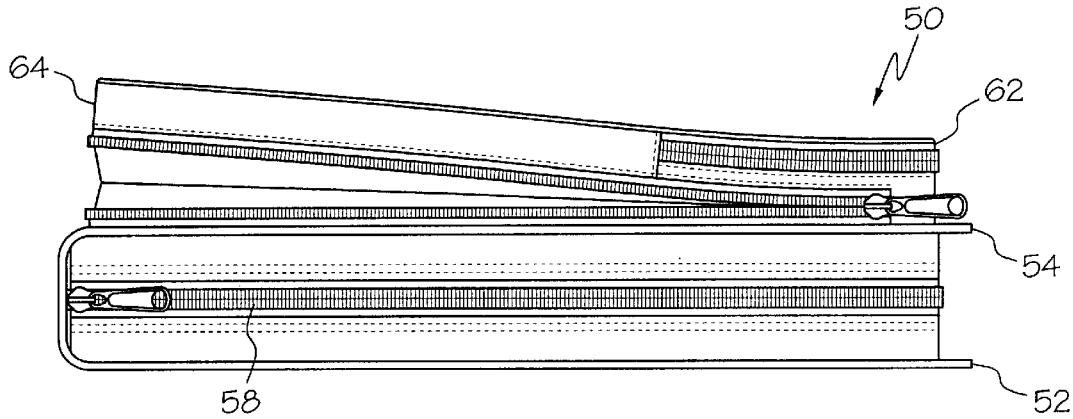
FIG. 5 is an end elevation of FIG. 3.

Thus, in the illustrated embodiment, when zipper 72 is in an unzipped state and the gusset is expanded as in FIGS. 5 and 6, the thickness of the pocket interior generally increases when moving from pocket access side 62 to side 64. However, it is recognized that the gusset and closure member could readily extend completely along side 62 and side 64 could be non-expandable so that the thickness of the pocket interior would generally decrease when moving from the pocket access side 62 to non-access side 64.

A further, thin pocket 80 may also be provided on the outer side of pocket 60 may also be provided. Access to this pocket may be provided by a releasable closure such as zipper 82. Preferably, the zipper 82 extends from side 62 to side 64 and provides a unique design element in addition to providing access to the interior of pocket 80. Pocket 80 can be utilized to carry papers or other thin items which do not require significant space.

Figure 9:
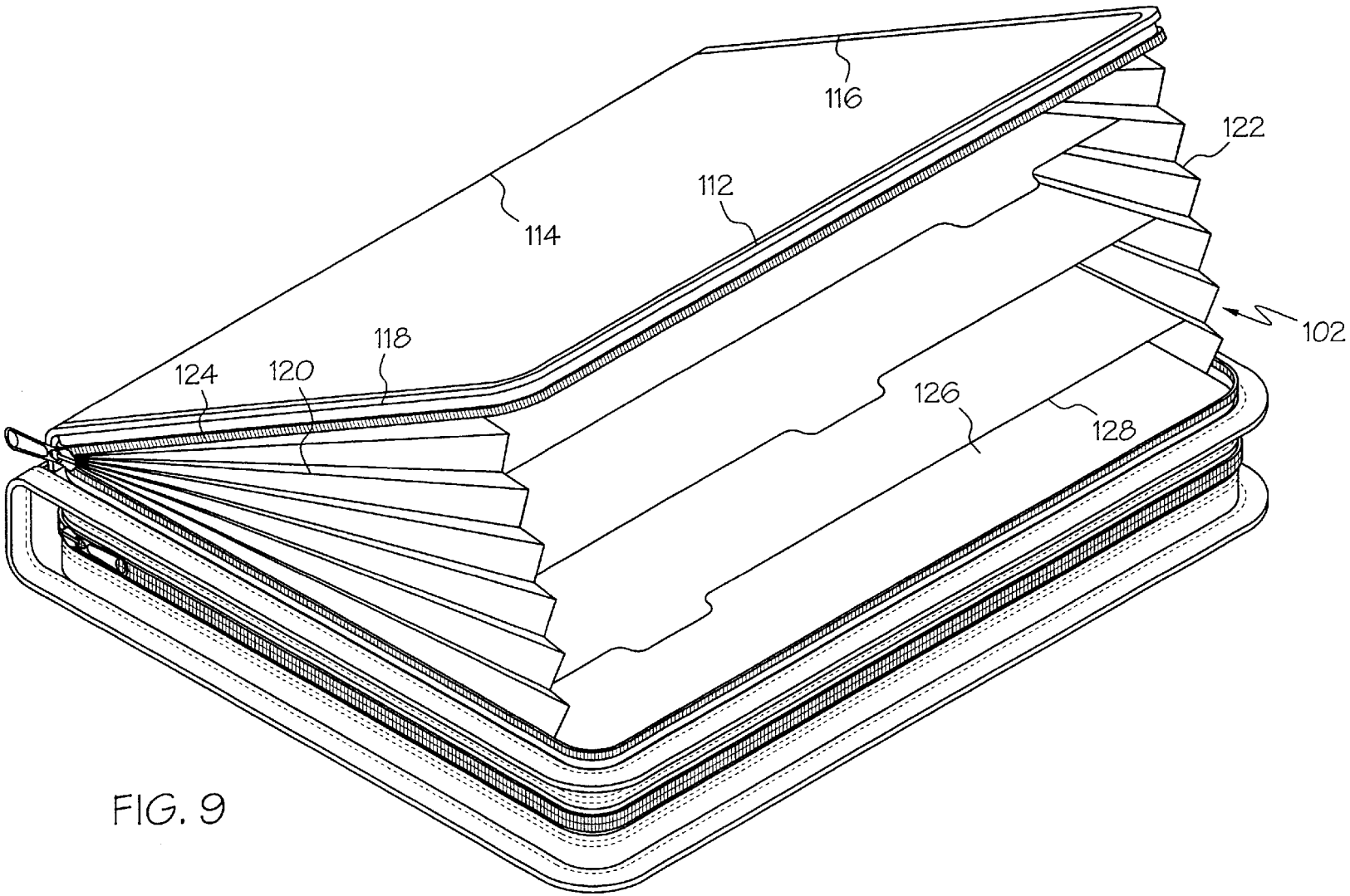
FIG. 9 is a perspective view of the binder of FIG. 8 showing the pocket in an opened state and expanded state.
Figure 10:
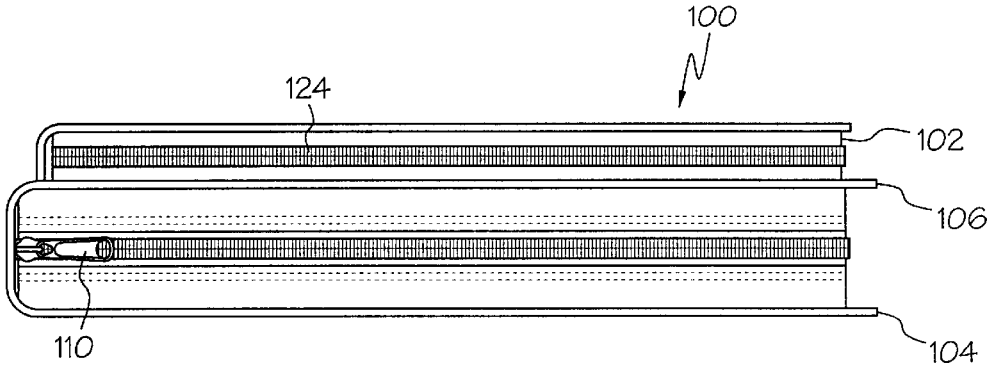
FIG. 10 is and end elevation of FIG. 8.
Figure 11:
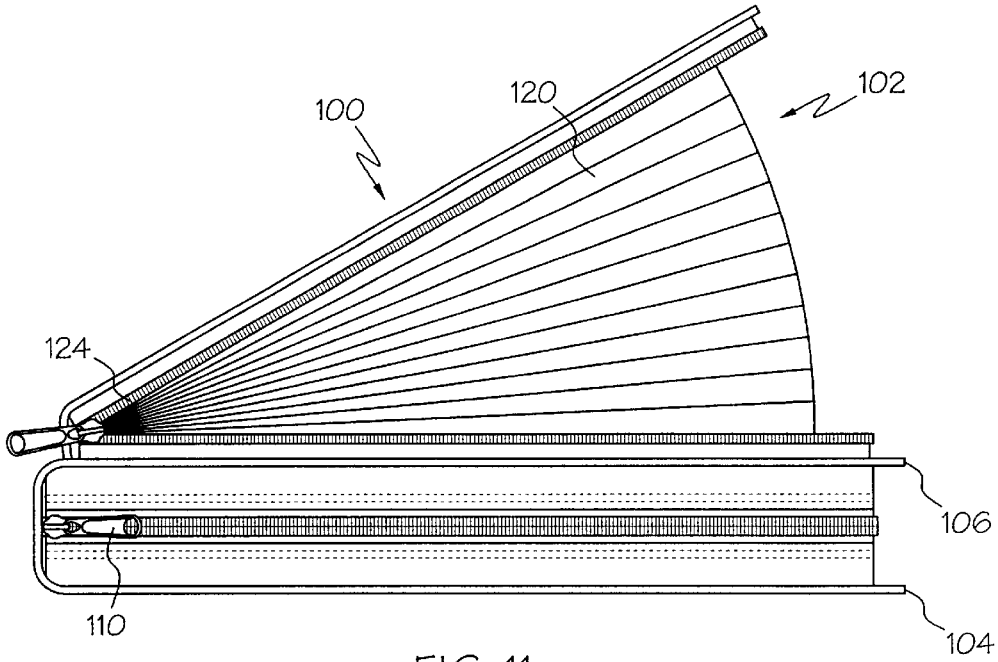
FIG. 11 is an end elevation of FIG. 9.

Reference is now made to FIGS. 8–11 which show another embodiment of a binder 100 with outside pocket 102. Binder 100 includes front panel 104, back panel 106 and spine 108 for movably connecting the two panels together. Zipper 110 controls access to an interior of the binder, holding the binder closed when zipped and permitting the binder to be folded open when unzipped. Pocket 102 is defined by opposed sides 112 and 114 and opposed sides 116 and 118 which extend therebetween. As shown in FIGS. 9 and 11, outside pocket 102 is expandable via gussets 120 and 122 provided on sides 116 and 118. A releasable closure in the form of zipper 124 extends completely along side 112 and substantially completely along the length of sides 116 and 118. Zipper 124 controls the expansion of the pocket 102 and also controls access to pocket 102. Notably, when the zipper 124 is in a closed or zipped condition (FIGS. 8 and 10) the pocket 102 remains in a relatively compact, thin condition. When the zipper 124 is in an unzipped state (FIGS. 9 and 11) the pocket 102 can expand to provide easy access to the pocket interior 126. As illustrated, the expansion of pocket 102 is greatest at side 112 which provides the opening for access. This configuration enables a user to easily flip through the contents of the pocket without removing all of the pockets contents. For example, where a series of papers are stored in the pocket 102 a user could flip through the papers easily so as to remove a desired paper only when identified. One or more dividers 128 can be provided within pocket 102, but such dividers are not required. Although not shown, binder 100 may also include a further pocket on the outside of pocket 102, similar to pocket 80 of binder 50.

Although the invention has been described and illustrated in detail it is to be clearly understood that the same is intended by way of illustration and example only and is not intended to be taken by way of limitation. Accordingly, the spirit and scope of the invention are to be limited only by the terms of the appended claims.

What is claimed is:

1. A binder, comprising:

a front panel;

a back panel movably connected to the front panel; and at least one expandable pocket connected on at least one of the front panel or the back panel, the pocket including a first side having an opening for providing access to an interior of the pocket, second and third sides extending from respective ends of the first side to a fourth side, and a gusset extending at least partially along at least one of the second, third and fourth sides, said pocket including a releasable closure for holding the pocket in a non-expanded state when closed and for permitting expansion of the pocket when opened, said releasable closure extending at least partially along a length of said gusset along said fourth side.

2. The binder of claim 1 wherein said gusset extends at least partially along the second and third sides and completely along the fourth side, and the releasable closure comprises a zipper which extends around a length of the gusset.

3. The binder of claim 1 wherein the first side is substantially non-expandable and when the pocket is in an expanded state a front to back thickness of the pocket increases from the first side toward the fourth side.

4. The binder of claim 2, further comprising a second releasable closure along the opening for controlling access to the pocket interior.

5. The binder of claim 3 wherein the second releasable closure comprises a zipper.

6. The binder of claim 2 wherein an outer side of the pocket includes a second pocket thereon, the second pocket accessible via a zipper which extends across an outer face of the pocket from the first side to the fourth side.

7. The binder of claim 1 wherein said gusset extends at least partially along the second and third sides and completely along the first side, and the releasable closure comprises a zipper which extends around a length of the gusset.

8. A binder comprising:

a front panel;

a back panel movably connected to the front panel; and at least one expandable pocket connected on at least one of the front panel and the back panel, wherein the pocket includes a first side having an opening for providing access to an interior of the pocket, second and third sides extending from respective ends of the first side to a fourth side, a first gusset extending at least partially along the second side and a second gusset extending at least partially along the third side for allowing the pocket to expand, the pocket including a releasable closure for holding the pocket in a non-expanded state when closed and for permitting expansion of the pocket when opened, the releasable closure extending along substantially the entirety of the second, third and fourth sides.

9. The binder of claim 8 wherein the fourth side is non-expandable, and when the pocket is in an expanded state a front to back width of the pocket decreases from the first side toward the fourth side.

10. The binder of claim 9 wherein the interior of the pocket includes a plurality of dividers.

11. The binder of claim 1 wherein the back panel is movably connected to the front panel via a spine of the binder.

12. A binder comprising:

a front panel and a back panel movably connected together;

an expandable pocket positioned on an outer surface of one of said front or back panels, said expandable pocket having an inner cavity and a mouth providing access to said inner cavity, and at least one gusseted surface extending at least partially along said pocket;

a first releasable closure extending at least partially along said at least one gusseted surface for preventing expansion of said pocket when said first releasable closure is closed and for allowing expansion of said pocket when said first releasable closure is open; and a second releasable closure extending along said mouth for selectively opening and closing said mouth to control access to said inner cavity.

* * * * *